United States Patent [19]

Kennedy

[11] 4,135,329

[45] Jan. 23, 1979

[54] VEHICLE WITH SPRING MOTOR OPERABLE IN RUNNING AND REWIND MODES

[75] Inventor: Melvin Kennedy, Hampton Bays, N.Y.

[73] Assignee: Nagel/Kennedy & Associates

[21] Appl. No.: 837,908

[22] Filed: Sep. 29, 1977

[51] Int. Cl.[2] ..... A63H 29/24; F03G 1/00

[52] U.S. Cl. ..... 46/206; 185/39; 185/43; 185/DIG. 1

[58] Field of Search ..... 185/39, 43, 44, DIG. 1; 46/201, 202, 204, 206

[56] References Cited

U.S. PATENT DOCUMENTS

| | | | |
|---|---|---|---|
| 824,248 | 6/1906 | Kingsbury | 185/39 |
| 3,812,953 | 5/1974 | Darda | 185/37 |
| 4,053,029 | 10/1977 | Darda | 185/39 |
| 4,077,156 | 3/1978 | Osano | 46/206 |

FOREIGN PATENT DOCUMENTS

| | | | |
|---|---|---|---|
| 635944 | 4/1950 | United Kingdom | 46/206 |

*Primary Examiner*—F. Barry Shay

[57] ABSTRACT

An improved spring motor in combination with a toy vehicle which can be easily manufactured and which can be wound up by moving the car forwardly and rearwardly in reciprocating movement without changing the physical configuration of the motor. The motor includes a first motor member about which a coil spring is engaged and a second motor member coaxial therewith and motion transmitting means interconnecting the two members such that the first motor member is rotated in response to rotation of the second member in the same direction but at a slightly slower speed. Power take-off means connect the motor to an item to be driven such as the rear wheels of a car. The motor is rewound through the power take-off means during which ratchet means allow the rotational motion transmitting means to be ineffective and during which a rewind ratchet holds the first motor means stationary to achieve high speed spring windup.

13 Claims, 6 Drawing Figures

VEHICLE WITH SPRING MOTOR OPERABLE IN RUNNING AND REWIND MODES

The present invention relates generally to spring motors and particularly to spring motors which are adaptable for use in toys of various types. The specific embodiment which will be described below provides particular utility in a minature toy car which can be easily and conveniently wound up by pushing the car rearwardly or alternatively pushing the car forwardly and rearwardly as will be described.

Spring motors are, of course, very old and a wide variety of such motors are well known and well developed. It is a requirement for use of such motors in toys that they are dependable in operation, inexpensive in manufacture and easily rewound. Each of these requirements have been, to varying degrees, met by prior art constructions. However, many of the prior art units fail at achieving one or more of these goals and, to the inventor's knowledge all prior units have failed in satisfactorily reaching all of the goals.

The most common spring motor, often called a clock spring motor, has a conventional spiral round clock spring which delivers power through a series of pairs of reduction gears each of which are mounted on separate axles and separate bearings. These motors are traditionally wound by a key or other device placed at a location at or fairly near the beginning of the gear train such that winding can be accomplished with far fewer turns than unwinding. Although this general type of construction is quite inexpensive, it is inefficient in that there are high losses because of the many gear interconnections and bearing losses. Furthermore, rewinding is inconvenient in that a key or some external device must be used for the rewinding. At the other extreme, highly sophisticated spring motors have been developed such as the unit shown in the German Offenlegungschrift No. 2461625 of July 8, 1976 issued to Helmut Darda and U.S. Pat. Nos. 3,812,933 and 3,981,098 issued to the same inventor. The Darda motor has the advantage of efficiency in delivering power from a coiled spring to the final drive with relatively little loss and it also has the advantage of being able to be rewound by directly moving the output shaft (the rear wheels of a car). However, this units has substantial disadvantages in its extremely high cost and difficulty, if not impossibility, of manufacture in normally equipped toy producing factories. In addition, the Darda unit has the disadvantage that in order to place the motor in its rewind configuration, the child must press downwardly on the car to trigger one element to change the configuration of the motor from its running mode to its rewinding mode.

Accordingly, it is an object of the present invention to provide an improved spring motor which is relatively easily and inexpensively manufactured, which efficiently delivers a high portion of the energy stored in its spring to the ultimate drive and which is easily and efficiently rewound by a child. In general, it is an object of the present invention to provide a superior spring motor, eliminating the disadvantageous characteristics of prior art motors and comprising a device which has those characteristics sought to be achieved by the various prior art constructions.

The inventor has determined that a spring motor, when placed for example in a miniature toy vehicle, can be conveniently and reasonably wound up by a reciprocating front and rear movement of the vehicle provided that the rearward movement produces substantially more winding up of the spring than an equivalent forward movement permits unwinding of the spring. This is in conflict with the concept and structure incorporated in motors such as the Darda motor where, by the provisions of a rather complicated structure, the spring can be wound upon both forward and rearward movement of the car. The inventor has determined that it is unnecessary to provide complicated and sophisticated structures in order to produce rewinding of the spring on both a forward as well as a rearward movement of the car. It is sufficient to simply rely upon a repetitive forward and rearward movement wherein, within a relatively few numbers of reciprocatory movements, the spring motor is completely wound.

In accordance with an illustrative embodiment of the present invention, applicant has provided a spring motor for use in a toy vehicle which motor is operated both in a running mode and in a winding mode with no change in its physical configuration between the two modes. There is a first motor member comprising an internal motor shaft to which is attached a flat coil spring spirally wound around that motor shaft. A second motor member is coaxial with the first motor member and is connected to the outer end of the spirally wound spring. Rotational motion transmitting means, including a one way ratchet or other one way transmission means, is mounted between said first motor member and said second motor member for transmitting rotational power when the motor is operating in its running mode. The rotational transmission means function to turn the first motor means in response to turning of the second motor means, in the same direction but at a slightly slower rotational speed. A drive shaft is engaged with said rotational transmitting means to provide a takeoff point for rotational power from the motor and, typically, that drive shaft is connected to the driving wheels of the miniature toy vehicle. A one way, rewind ratchet mechanism, or other one way clutching means, is provided between the first motor member and the frame of the motor or car to prevent the first motor member from moving in a direction which would unwind the spiral spring. As such, when the drive shaft is turned in the windup direction (when the car is pushed rearwardly), it transmits windup movement through the rotational transmitting means to the second motor member to drive that second motor member in a direction to rewind the spiral spring while the first motor member is held against unwinding by the rewind ratchet. As the drive shaft is moved in rewind rotational motion, the one way clutch mechanism (the rewind ratchet) holds the first motor member against movement and the rotational transmitting means causes the second motor member to move in the rewind direction. The gear ratios are such that for each revolution of the drive shaft in the rewind direction, there is several times as much winding up of the coil spring as there is unwinding of that spring upon a similar revolution of the drive shaft in unwinding or running direction. Thus, the spring motor can be wound up by rotating the drive shaft alternatively in opposite directions.

The above brief description, as well as further objects, features and advantages of the present invention will be best understood by considering the following detailed description of one presently preferred embodiment of the invention taken in conjunction with the accompanying drawings wherein.

Figure 1:
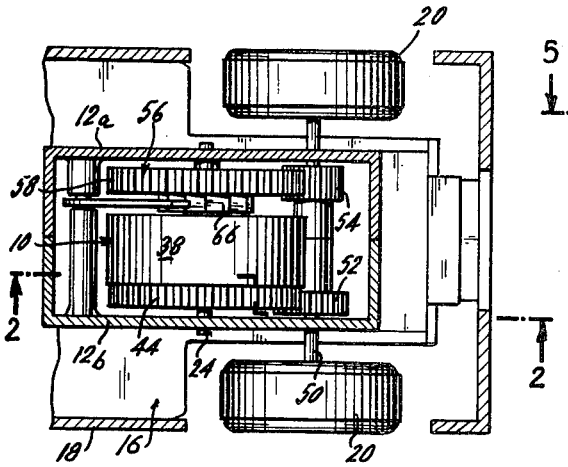
FIG. 1 is a sectional view along a horizontal plane of the rear portion of an automobile showing a spring motor in accordance with the present invention; the section passes through the cover or frame of the motor and shows all internal elements of the motor as well as the chassis, rear axle and rear wheels in full line.
Figure 5:
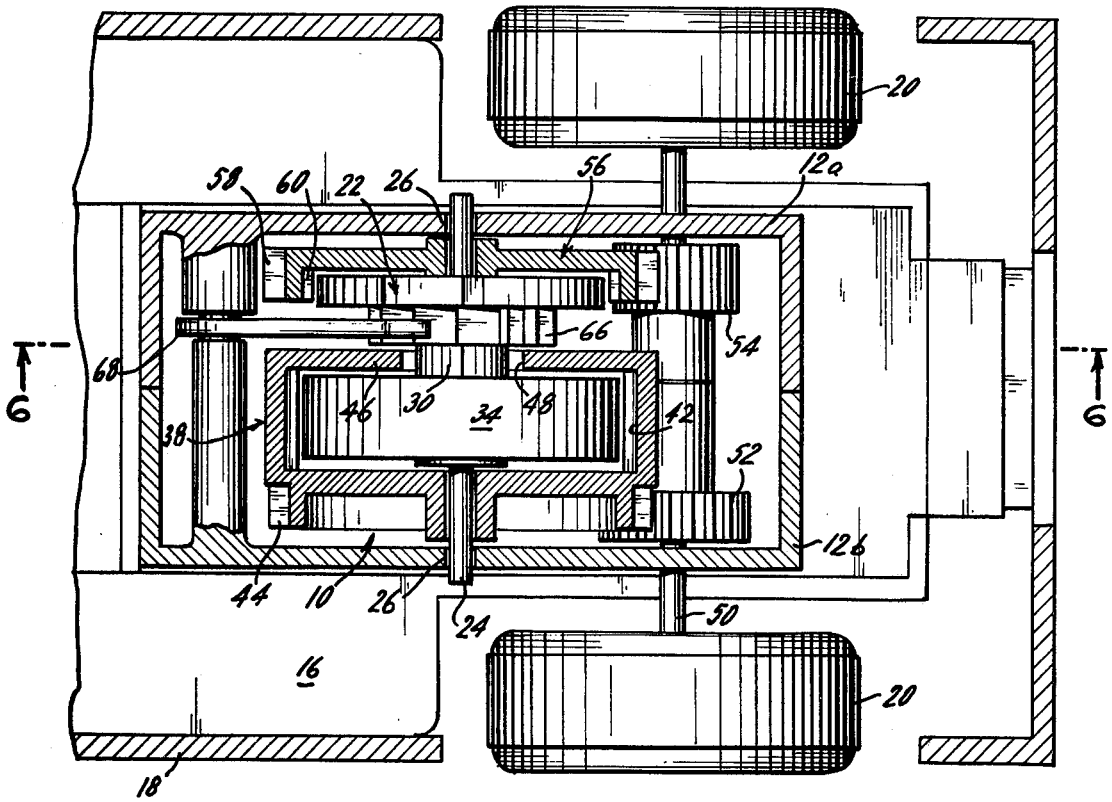
FIG. 5 is an enlarged sectional view of the motor taken along the line 5—5 of FiG. 2 looking in the direction of the arrows.

Now referring particularly to the drawings, numeral 10 refers to a spring motor which is constructed in accordance with the present invention. The motor 10 is contained within a two part housing 12 consisting of two parts, 12*a* and 12*b*, which form the rectangular frame as seen in FIGS. 1 and 5. A side view of the housing 14 may be seen in FIGS. 2 and 6. In these illustrations, the motor 10 is mounted within a miniature automobile 14 of approximately HO gage and which has a chassis 16, a body 18 and a pair of rear driving wheels 20.

The spring motor 10 has a relatively few number of individual pieces, some of which have separate and single identifiable functions and others of which have multiple functions as will appear below. A multiple function member 22, including a motor shaft, a rewind ratchet and ratchet pawls all to be described below, is mounted for rotation on a metal axle 24 which in turn is positioned with the bearing openings 26 formed in the housing sections 12*a* and 12*b*. The multiple function member 22 has a coaxial bearing opening 28 formed along its central axis and it is mounted to freely rotate around the axle 24. The member 22 has, on one side of it, the main motor shaft structure 30 which functions as a first motor member and is the part of the motor to which the inner end of the spiral spring is mounted. Specifically, the motor shaft structure 30 is formed with a hook shaped nose portion 32 to provide an anchor point for the internal end of a spiral spring.

Figure 2:
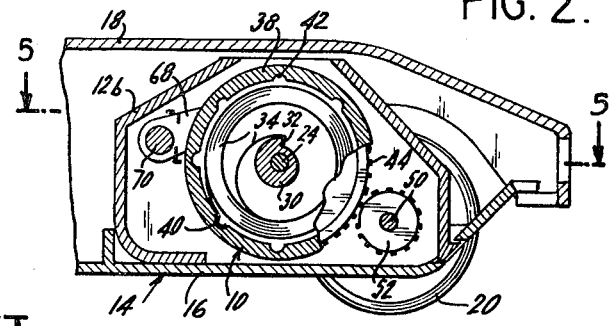
FIG. 2 is a side sectional view of the device shown in FIG. 1 taken along the line labelled 2—2 in FIG. 1.
Figure 3:
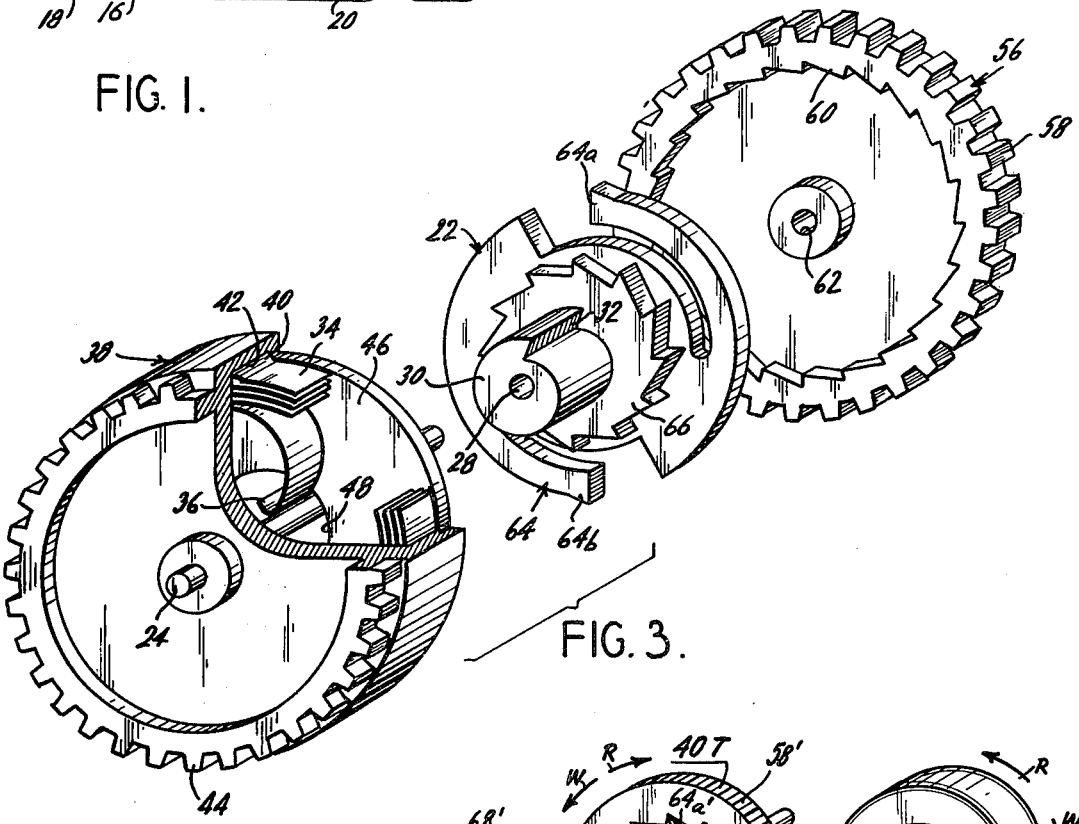
FIG. 3 is an exploded, enlarged scale, isometric view of a portion of the spring motor shown in FIGS. 1 and 2.

As may be best seen in FIGS. 2 and 3, a spiral spring 34, of the type generally well known as a clock spring, is provided with a hook shaped inner end of a shape that is compatible with the hook shaped nose section on the first motor member 30. It will be appreciated that there will be a positive engagement between the spiral spring 34 and the motor shaft of the first motor member 30 when the spring moves in a counterclockwise direction as viewed in FIGS. 2 and 3 relative to the motor shaft; when there is relative movement in the opposite direction, such as when a child pushes the car forwardly when the motor is completely unwound or when the car is coasting, the interconnections will allow for such free movement thereby providing a safety factor. At its other end, the spiral spring 34 is cooperatively engaged with the inner cylindrical surface of a drum member 38 which functions as the second motor member. The spring 34 is attached to the drum member 38 made by means of a protrusion 40 formed adjacent the outer end of the spring 34 and a series of complementary depressions 42 formed on the inner surface of the drum member 38. The protrusion 40 is normally maintained within one of the depressions 42. If, however, the spring is overwound, the protrusion 40 pops out of the depressions 42 and re-engages in another one of the depressions 42 at some point at which the stress on the spring does not exceed its design criteria.

When the spring 34 is wound, it will cause the drum member or second motor member 38 to rotate in a clockwise direction (FIGS. 2 and 3) around the motor shaft or first motor member 30. A gear 44 is formed on the outer face of the second motor member or drum member 38 for connection to the rotational motion transmitting means which will be described in greater detail below. The inner face of the drum member 38 is closed off by a retaining disc 46 which is snapped into place and functions to insure the axial retention of the coil spring 34 within the drum 38. A central opening 48 is formed within the disc 46 to provide clearance room for the insertion of the motor shaft 30 therethrough.

Figure 6:
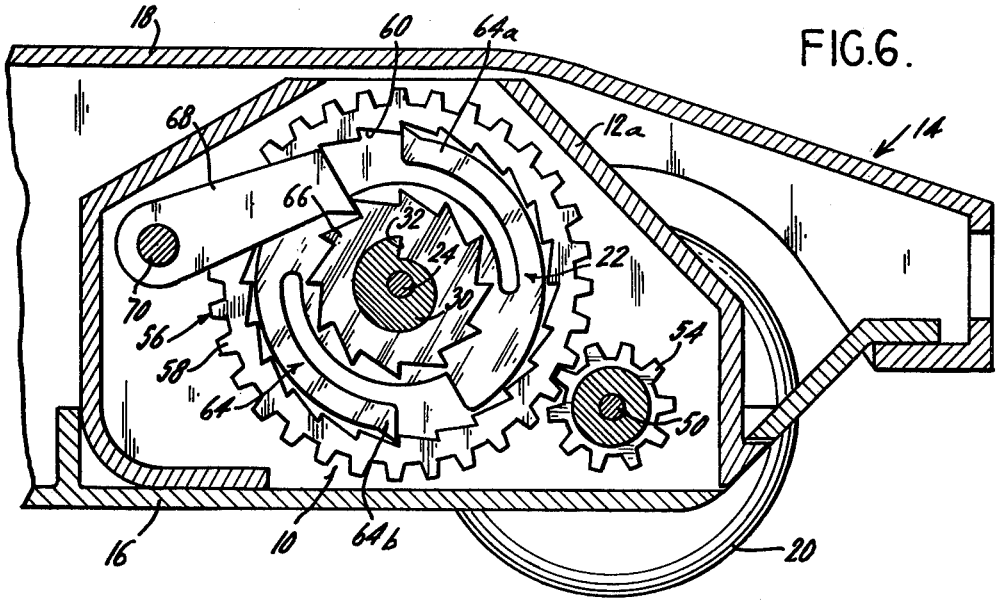
FIG. 6 is a sectional view of the spring motor taken along the line 6—6 of FIG. 5.

As the second motor member or drum member 38 rotates in a clockwise direction as seen in FIGS. 2, 3 and 6, the first motor member or motor shaft 30 is caused to rotate in the same direction but at a somewhat slower speed. The means that cause that rotation will now be described. A rotating shaft 50 is mounted in journal openings in the frame 12*a* and 12*b* for rotation parallel to the axle 24 and below and rearwardly thereof. To this shaft and within the frame 12 is fixed a first pinion gear 52 which is in engagement with a drum gear 44. Also fixed to the rotating shaft 50 and within the frame 12 is a second pinion gear 54. The second pinion gear 54 is operatively engaged with a combined external gear and internal ratchet member 56 which has an external gear 58 formed on its outer circumference. An internal circular ratchet is formed on the inner cylindrical surface of member 56 and a central bearing opening 62 is provided to mount the member 56 for free rotation on the metal axle shaft 24. Thus, when the second motor member 38 rotates in a clockwise direction (FIGS. 2, 3 and 6), the rotating shaft 50 and the pinion gears 52, 54 will rotate in a counterclockwise direction thereby producing clockwise rotation of the external gear and internal ratchet member 56 about the metal axle shaft 24. As will be explained in detail below, the gear ratios between the gears 44 and 52 on the one hand (the second motor member and the first pinion gear) and 58 and 54 on the other hand (the combined gear and internal ratchet member and the second pinion gear) are such that rotation of the second motor member 38 and its integral gear 44 will produce slightly slower rotation of the gear 58 and internal ratchet 60.

We will now explain how that slightly slower rotation of the external gear and internal ratchet member 56 is transmitted to the first motor member 30. The multiple function member 22 includes, in addition to the motor shaft or the first motor member 30 which is described above, an integrally formed male ratchet member or pawl 64 which is used during the running mode of the motor and female rewind ratchet member 66. The male running ratchet has a pair of ratchet arms 64*a* and 64*b* which are sprung outwardly and engage against opposed teeth of the internal ratchet 60 on the gear and ratchet member 56. Thus when the gear and ratchet 56 is turned in a clockwise direction (FIGS. 2, 3 and 6), the male ratchet member 64 is similarly moved in a clockwise direction and in turn causes clockwise movement of the motor shaft 30 (the first motor member). Conversely, any relative movement between those parts in the opposite direction causes slippage between the internal ratchet 60 and the male ratchet members 64. It is by means of the ratchet composed of the internal ratchet 60 and the male ratchet member 64 that the chain of rotational movement (at a slightly slower rotational speed) is transmitted from the second motor member 38 (through the gears 44 and 52, the shaft 50 and the gears 54 and 58) to the first member 30.

In accordance with the design of the motor 10 and in accordance with the present invention, it is necessary to hold the first motor member or motor shaft 30 stationary during the rewinding operation. This is accomplished in the present embodiment by the provisions of the rewind ratchet 66 (FIGS. 3, 5 and 6) in combination with a rewind pawl 68. The rewind ratchet is part of the multiple function member 22. Since the winding operation of the motor 10 is accomplished by moving the car rearwardly, which action has the effect of driving the drum or second motor member 38 (and therefore the outer end of the spring 34) in a counterclockwise direction (FIGS. 2, 3 and 6), it is desirable to prevent the motor shaft of the first motor member 30 (and therefore the inner end of the spring 34) from moving in a counterclockwise direction. Accordingly, the pawl 68 is mounted forwardly and slightly above of the metal axle shaft 24 in position such that its nose 68*a* engages one of the teeth of the rewind ratchet 66 preventing counterclockwise motion of that ratchet and thereby preventing counterclockwise motion of the entire multiple function member 22, including the motor shaft or the first motor member 30. The rewind pawl 68 is mounted for pivotal movement on a rewind pawl shaft 70 which is formed in two parts extending from the inner surfaces of the frame housing sections 12*a* and 12*b* as may be seen in FIGS. 1, 5 and 6. The rewind pawl freely pivots such that it engages the rewind ratchet 66 to prevent counterclockwise movement and to permit clockwise movement.

The above description will be best understood and is augmented by the following description of the operation of the motor 10 within the car 14. Consideration will first be given to the operation of the motor 10 in its running phase. When the coil spring 34 is fully wound, the second motor member 38 tends to move in the clockwise direction (FIGS. 2, 3 and 6). Through the gears 44, 52, 54 and 58 and the multiple function member 22, the first motor member or motor shaft 30 is rotated in the same direction at a slightly slower speed. Specifically, for each 53.3 revolutions of the second motor member 38, the first motor member 30 rotates 43.3 revolutions; that is, the first motor member rotates at about 80% of the rotational speed of the second motor member. Stated in another way, the second motor member 38 must rotate approximately five full turns before there is one full unwinding turn of the spring 34 because, as the second motor member rotates five turns, the first motor member 30 (the inside end of the spring 34) rotates approximately four turns. This is governed by the fact that the second motor member gear 44 has 38 teeth and its mating pinion gear has 14 teeth so that the rate of rotation therebetween is 1:2.71. The second pinion gear 54 has 12 teeth and the mating external gear has 40 teeth so that the ration of rotation therebetween is 3.33:1 since the gears 52 and 54 are tied together, the resulting ratio of rotation between the first motor member and the second motor member is 0.814:1.0. As such, the effective rate of unwinding of the spring 34 is only approximately 20% of the rotational speed of the second motor member 38. Thus, the motor in accordance with the present invention achieves a significant gear ratio with only two rotating shafts and two gear interconnection and, therefore, very little frictional loss.

When operating in its rewind mode, the child using the car 14 simply pushes the car rearwardly and as a result thereof, there is rapid winding of the spring motor 10. If the child reciprocates the car forwardly and rearwardly, there will be some loss of the winding effort each time the car goes forwardly; however, that loss is relatively slight; from a play value point of view and as an engineering consideration, that loss is negligible. Specifically, when the child pushes the car rearwardly, the rear wheels 20 turn in a clockwise direction (FIGS. 2, 3 and 6) causing the first and second pinion gears 52 and 54 to move in a clockwise direction. Those gears in turn cause the gears 44 and 58 both to turn in a counterclockwise direction. The counterclockwise movement of the gear 58 has no effect on anything since it simply causes the internal ratchet 60 to move forwardly producing a slip between that internal ratchet 60 and the male ratchet 64; the sprung teeth of the male ratchet 64 simply pass over the teeth of the internal ratchet 60 as they go by and the rewind pawl ratchet and pawl 66, 68 prevent counterclockwise movement. However, the first pinion gear 52 turns the gear 44 and thereby the second motor member 38 and the outer end of spring 34. As stated above, as the outer end of the spring 34 is pulled by the second motor member in a counterclockwise direction, the motor shaft of first motor member 30 is held against such movement by the rewind pawl and ratchet 68, 66. As a result, rearward movement of the car causes direct winding of the spring 34 through the gear ratio of the gears 52, 44. Normally, the child will move the car both rearwardly and forwardly while rewinding. Because there is an approximately 5 to 1 ratio between the winding and the unwinding of the spring motor 10, each reciprocatory cycle will be approximately 80% efficient in winding up the motor (as compared to only rearward movement). The loss of approximately 20% efficiency has been found to be and is concluded to be by the inventor of no practical significance. Of course, any person using a miniature toy car incorporating the motor 10 (whether child or adult) will not know these details and will in no way be conscious of the fact that there is any loss whatsoever in a reciprocatory rewinding operation. As a pragmatic fact, when a person playing with a toy incorporating a motor such as that described herein goes through the rewinding operation, that operation is produced very quickly by forward and backward movement of the car and, upon completion, the car is ready for operation again. In the motor and car illustrated herein, a rewind of four forward and rearward movements of one foot each winds the motor enough for the car to travel 16 feet forwardly under its own power.

It will be recalled that there are safety precautions built into the motor 10 which prevent an overwinding of the spring 34. Specifically, the protrusion 40 on the outer end of the spring 34 and the series of depressions 42 on the inside of the drum 38 prevent any overwinding. When the user of the motor comes to the end of the proper rewinding he hears a clicking sound which is, in fact, the protrusion 40 bouncing out of one depressions 42 and into the next one. That clicking sound can function as a signal to indicate the completion of the rewind process.

Figure 4:
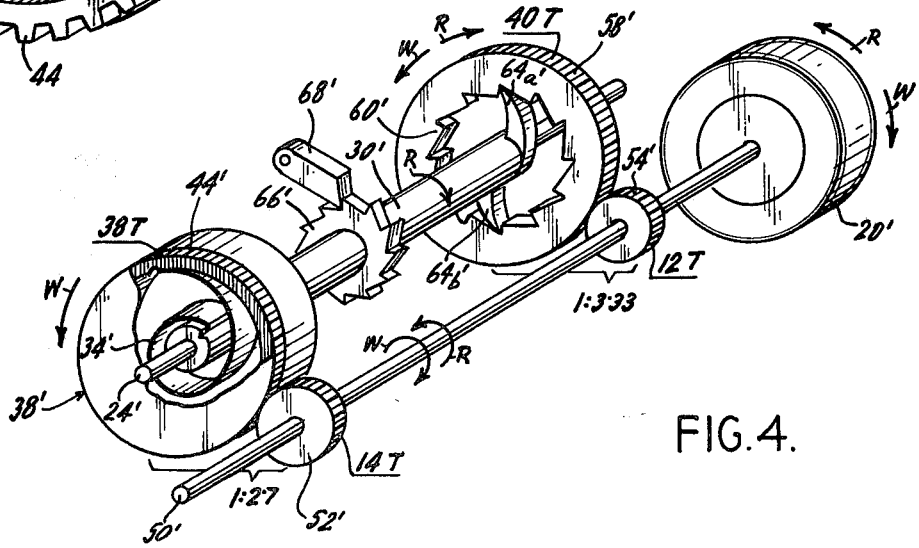
FIG. 4 is a schematic view of the spring motor of the present invention with arrows drawn illustrating the various directions of movement of the parts in the rewind and running mode of the motor.

The operation of the motor 10 may be more easily understood by referring to the schematic FIG. 4 which presents the various elements in an exploded and/or schematic fashion which makes them somewhat more easily seen. The following description of the operation is given with reference to FIG. 4 and the various part numbers are given with a superscript, such as the motor 10' to indicate its appearance in schematic FIG. 4 rather than in the absolute showings in FIGS. 1 through 3, 5 and 6.

Referring to FIG. 4, the rewind operation is provided by moving the entire motor 10' and the car in which it is mounted rearwardly, which causes the rear wheel 20' to rotate in a clockwise direction as shown in FIG. 4. This causes the rotating shaft 50' to rotate in a clockwise direction which, in turn, causes the first and second pinion gears 52', 54' to also rotate in a clockwise direction. The pinion gears are always engaged with the second motor member gear 44' and the external gear 58' respectively and thus, those two gears are caused to rotate in a counterclockwise direction as the rear wheel 20' is rotated rearwardly. The counterclockwise direction of external gear 58' is actually a lost motion because that gear is mounted for rotation about the metal axle shaft 24' and its internal ratchet 60' slips in lost motion relative to the ratchet arms **64*a*' and 64*b*'. Thus, in the rewind motion, the movement of the second pinion gear 54' and the external gear 58' are neutralized by the slipping of the ratchet 60', 64'. However, the first pinion gear 52' is effective to wind-up the spiral springs 34' by driving the second motor member gear 44' and thereby the drum member or second motor member 38' in a counterclockwise direction. As the second motor member 38' is moved in a counterclockwise direction, the outer end of the coil spring 34' is similarly drawn in a counterclockwise direction, thereby tightening the spring 34' about the motor shaft or first motor member 30'. The tendency of the motor shaft or first motor member 30' to rotate in a counterclockwise direction under impetus of the spring 34' is completely precluded by means of the rewind ratchet 66'. Specifically, the rewind ratchet pawl 68' mounted on the pivot 70' engages the teeth of the ratchet 66' and prevents that ratchet and the first motor member 30' from rotating in a counterclockwise direction. Thus, rewinding is simply achieved by the clockwise rotation of the rear wheel 20', the corresponding clockwise rotation of the first pinion gear 52', the counterclockwise rotation of the second motor member 38' and the winding up of the spring 34' about the first motor member 30' which is held against movement by the rewind ratchet 66'**.

With the spring 34' wound, the user of the toy car can simply release the car, and the motor 10' will drive the rear wheel 20' in driving movement as will be described. The outer end of the spring 34' will cause the second motor member 38' to rotate in a clockwise direction as shown in FIG. 4, which will cause the first pinion gear 52' to rotate in a counterclockwise direction. This causes the rotating shaft 50' to similarly rotate in a clockwise direction and also causes the rear wheel 20' to rotate in a clockwise or running direction. As the rear wheel 20' drives the car forwardly, the second pinion gear 54', through the rotational power transmitting loop causes the first member or motor shaft 30' to rotate in a clockwise direction at a rotational speed slightly less than the unwinding of the second motor member 38'. Specifically, the second pinion gear 54' is connected to the external gear 58' which, through the internal ratchet 60' and ratchet arms 64', causes the first motor member 30' to rotate in a clockwise direction. In the specific embodiment illustrated herein, the external gear 44' has 38 teeth (designated by the expression 38T in FIG. 4), and the first pinion gear 52' has 14 teeth producing a gear ratio of 1:2.71. The external gear 58' has 40 teeth and the second pinion gear 54' has 12 teeth, producing a gear ratio of 1:3.33. Therefore, for each turn of the second motor member 38' the drive shaft 50' rotates 2.71 times. However, it requires 3.33 rotations of that same drive shaft 50' to drive the external gear 58' and, therefore, the first motor member 30' through one complete rotation. Thus, as the drive shaft 50' rotates 2.71 times, the first motor member 30' rotates about 80% of one revolution thus producing a net unwinding of the spring 34' of about 1/5 revolution for every 2.11 revolutions of the drive shaft 50'. Stating it another way, the rear wheels 20' of the car rotate about 14 times for each full turn of unwinding of the spring 34'.

The foregoing description of the motor 10 is illustrative of applicant's invention which allows a very simple motor to be manufactured at reasonable cost and which provides a power source which is both highly dependable and easy to operate. There are obvious variations in the design which will occur to many. For example, power can be extracted from the system at locations other than at the drive shaft and other means can be used instead of the gears and the pawl and ratchets to provide the rotation transmission and the lost motion. Nevertheless, the illustrated and described embodiment teaches the concept of the invention and shows the inventor's presently preferred commerical embodiment of the invention. The appended claims should be interpreted in accordance with the scope of the invention.

What is claimed is:

1. A spring motor operable in a running mode and in a rewind mode without any change in its physical configuration comprising:

a. a motor frame;

b. a first motor member;

c. a flat coiled spring wound in a spiral about said first motor member, the inner end of which is secured thereto;

d. a second motor member secured to the outer end of said spirally wound spring;

e. means mounting said first and second motor members in said frame in a fixed coaxial relationship and for relative rotational movement therebetween;

f. a shaft mounted in said frame for rotational movement in fixed parallel relationship to the axis of said second motor member;

g. rotational motion transmitting means interconnecting said shaft and said second motor member for rotating said shaft at a higher rotational speed than the rotational speed of said second motor member;

h. rotational motion transmitting and lost motion means interconnecting said shaft and said first motor member for rotating said first motor member in response to rotation of said shaft when said spring motor is operated in the running mode, said rotational motion transmitting and lost motor member turning said first motion means at a rotational speed less than the rotational speed of said second motor member, said lost motion means effectively disconnecting said shaft and said first motor member when said motor is operated in its rewind mode;

i. rewind ratchet means preventing rotation of said first motor member in the direction of unwinding of said spiral spring and permitting rotation thereof in the direction of winding said spiral spring; and j. rotational power take-off means connected to said motor at one of said shaft, said second motor member or said rotational motion transmitting means for taking rotational power from said motor and for transmitting rewind movement thereto;

rotation of said power take-off means in a direction opposite to the normal running direction causing a rewinding of said spiral spring at a rate several times faster than said spring unwinds when said power take-off means rotates in the normal running direction.

2. A spring motor in accordance with claim 1 wherein the securement of said spiral spring to said first motor member precludes movement therebetween in the outward direction of the spiral and allows movement therebetween in the inward direction of said spiral.

3. A spring motor in accordance with claim 1 wherein said rotational motion transmitting means interconnecting said shaft and said second motor member and said rotational motion transmitting means interconnecting said shaft and said first motor member comprises pairs of mating gears.

4. A spring motor in accordance with claim 1 wherein said lost motion means comprises a ratchet and at least one pawl.

5. A spring motor in accordance with claim 1 wherein said rewind ratchet means comprises a circular ratchet connected to said first motor member and a pawl pivotally mounted on said frame.

6. A spring motor in accordance with claim 1 wherein said rotational power take-off means is connected to the driving wheels of a toy miniature vehicle and said frame is mounted within said vehicle.

7. A spring motor in accordance with claim 1 wherein said power take-off means comprises an extension of said shaft.

8. A spring motor in accordance with claim 7 wherein said extension of said shaft is connected to a driving wheel of a toy miniature vehicle and said frame is mounted within said vehicle.

9. A miniature toy vehicle having at least one driving wheel and a spring motor, said motor operable, without any change in its configuration, in both a running mode for driving said driving wheel in a forward direction and in a rewind mode in which reciprocating rearward and forward movement of said vehicle and rearward and forward turning of said driving wheel winds up said spring motor, said vehicle comprising:

a. a vehicle chassis;

b. a motor frame mounted in said chassis;

c. a first motor member;

d. a flat coiled spring wound in a spiral about said first motor member the inner end of which is secured thereto;

e. a second motor member secured to the outer end of said spirally wound spring;

f. means mounting said first and second motor members in said frames in a fixed coaxial relationship and for rotational movement therebetween;

g. a drive shaft mounted in said frame for rotational movement in fixed parallel relationship to the axis of said second motor member;

h. rotational motion transmitting means interconnecting said drive shaft and said second motor member for rotating said drive shaft at a higher rotational speed than the rotational speed of said second motor member;

i. rotational motion transmitting and lost motion means interconnecting said drive shaft and said first motor member for rotating said first motor member in response to rotation of said drive shaft when said spring motor is operated in the running mode, said rotational motion transmitting and lost motion means turning said first motor member at a rotational speed less than the rotational speed of said second motor member, said lost motion means effectively disconnecting said drive shaft and said first motor member when said motor is operated in its rewind mode;

j. rewind ratchet member preventing rotation of said first motor means in the direction of unwinding of said spiral spring and permitting rotation thereof in the direction of winding said spiral spring; and k. said driving wheel of said vehicle connected to said drive shaft; rotation of said driving wheel in the rearward direction causing rewinding of said spiral spring at a rate several times faster than said spiral spring unwinds when said driving wheel is rotated in the forward direction.

10. A miniature toy vehicle in accordance with claim 9 wherein the securement of said spiral spring to said first motor member precludes movement therebetween in the outward direction of the spiral and allows movement therebetween in the inward direction of said spiral.

11. A miniature toy vehicle in accordance with claim 9 wherein said rotational motion transmitting means interconnecting said drive shaft and said second motor member and said rotational motion transmitting means interconnecting said drive shaft and said first motor member comprise pairs of mating gears.

12. A miniature toy vehicle in accordance with claim 9 wherein said lost motion means comprises a ratchet and at least one pawl.

13. A miniature toy vehicle in accordance with claim 9 wherein said ratchet means comprises a circular ratchet connected to said first motor member and a pawl pivotally mounted on said frame.

* * * * *

UNITED STATES PATENT OFFICE

CERTIFICATE OF CORRECTION

Patent No. 4,135,329 Dated January 23, 1979

Inventor(s) Melvin Kennedy

It is certified that error appears in the above-identified patent and that said Letters Patent are hereby corrected as shown below:

On the cover sheet the title should read as follows:

-- Spring Motor Operable In Running And Rewind Modes --.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,135,329

DATED : January 23, 1979

INVENTOR(S) : Melvin Kennedy

It is certified that error appears in the above—identified patent and that said Letters Patent are hereby corrected as shown below:

Column 3, line 27, "14" should read --12--; column 3, line 52, insert --36-- after the words "hook shaped inner end". Column 4, line 31, change "a" to --the--; column 4, line 37, insert --60-- after the word "ratchet". Column 5, line 24, change "of" to --or--; column 5, line 63, change "rate" to --ratio--; column 5, line 65, change "ration" to --ratio--; column 5, line 66, change "since" to --. Since--. Column 6, line 27, delete "pawl". column 8, lines 63 - 64, change "motor member turning said first motion means" to --motion means turning said first motor member--. Column 10, lines 29 - 30, change "member preventing rotation of said first motor means" to --means preventing rotation of said first motor member--.

Signed and Sealed this

Sixteenth Day of December 1980

[SEAL]

Attest:

SIDNEY A. DIAMOND

Attesting Officer

Commissioner of Patents and Trademarks

UNITED STATES PATENT AND TRADEMARK OFFICE

CERTIFICATE OF CORRECTION

PATENT NO. : 4,135,329

DATED : January 23, 1979

INVENTOR(S) : Melvin Kennedy

It is certified that error appears in the above—identified patent and that said Letters Patent is hereby corrected as shown below:

Column 7, lines 62-63, change "clockwise" to read -- counterclockwise --.

Signed and Sealed this

*Twelfth* Day of *May 1981*

[SEAL]

*Attest:*

RENE D. TEGTMEYER

*Attesting Officer*

*Acting Commissioner of Patents and Trademarks*

UNITED STATES PATENT AND TRADEMARK OFFICE

CERTIFICATE OF CORRECTION

PATENT NO. : 4,135,329

DATED : January 23,1979

INVENTOR(S) : Melvin Kennedy

It is certified that error appears in the above—identified patent and that said Letters Patent is hereby corrected as shown below:

Column 7, lines 62-63, "clockwise" should read

-- counterclockwise --.

Signed and Sealed this

*Seventh* Day of *July 1981*

[SEAL]

*Attest:*

RENE D. TEGTMEYER

*Attesting Officer*

*Acting Commissioner of Patents and Trademarks*